US011874090B2

(12) United States Patent
Teetzel et al.

(10) Patent No.: US 11,874,090 B2
(45) Date of Patent: Jan. 16, 2024

(54) COVER SYSTEM FOR LASER ACCESSORY DEVICE

(71) Applicant: Wilcox Industries Corp., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 17/706,795

(22) Filed: Mar. 29, 2022

(65) Prior Publication Data

US 2022/0341708 A1 Oct. 27, 2022

Related U.S. Application Data

(60) Provisional application No. 63/179,732, filed on Apr. 26, 2021.

(51) Int. Cl.

| | |
|---|---|
| ***F41G 1/35*** | (2006.01) |
| ***F41G 1/36*** | (2006.01) |
| ***F41G 11/00*** | (2006.01) |
| ***F41G 1/34*** | (2006.01) |

(52) U.S. Cl.

CPC ..... *F41G 11/00* (2013.01); *F41G 1/35* (2013.01); *F41G 1/36* (2013.01)

(58) Field of Classification Search

CPC ... F41G 11/00; F41G 1/35; F41G 1/36; F41G 1/383; F41G 3/2616; F41G 3/2655; F41G 3/2666; F41G 3/2688; F41A 35/02; G02B 27/20

See application file for complete search history.

(56) References Cited

U.S. PATENT DOCUMENTS

| | | | | |
|---|---|---|---|---|
| 8,001,715 | B2 * | 8/2011 | Stokes | F41G 1/35 42/146 |
| 9,752,853 | B2 | 9/2017 | Teetzel et al. | |
| 10,086,527 | B2 | 10/2018 | Teetzel et al. | |
| 10,175,029 | B2 | 1/2019 | Teetzel et al. | |

(Continued)

FOREIGN PATENT DOCUMENTS

| | | |
|---|---|---|
| DE | 202019106217 U1 | 3/2021 |
| EP | 3314195 | 5/2018 |

(Continued)

OTHER PUBLICATIONS

Extended European Search Report dated Sep. 13, 2022 received in European Application No. 22165464.3.
English Machine Translation of DE 202019106217 U1.

*Primary Examiner* — Tracie Y Green
(74) *Attorney, Agent, or Firm* — McLane Middleton, Professional Association

(57) ABSTRACT

A laser accessory device comprises a housing having a front side having a port, a rear side opposite the front side, a left side, a right side opposite the left side, a top side, and a bottom side opposite the top side. One or more laser emitters within the housing are configured to emit a beam through the port. A first cover assembly is positioned on the front side, the first cover assembly including a first safety cover and a first frame securing the first safety cover to the housing. The first safety cover is movable between a closed position covering the port and an open position not covering the port.

20 Claims, 7 Drawing Sheets

(56) References Cited

U.S. PATENT DOCUMENTS

| | | | | |
|---|---|---|---|---|
| 10,942,005 | B2 | 3/2021 | Teetzel et al. | |
| 2014/0317988 | A1 | 10/2014 | Battis et al. | |
| 2016/0102943 | A1* | 4/2016 | Teetzel | F41G 1/35 42/113 |
| 2018/0180384 | A1 | 6/2018 | Zhang et al. | |

FOREIGN PATENT DOCUMENTS

| | | | |
|---|---|---|---|
| KR | 101550146 | B1 | 9/2015 |
| WO | 2016/207487 | A1 | 12/2016 |

* cited by examiner

COVER SYSTEM FOR LASER ACCESSORY DEVICE

CROSS REFERENCE TO RELATED APPLICATION

This application claims the priority benefit of U.S. provisional application No. 63/179,732 filed Apr. 26, 2021. The aforementioned application is incorporated herein by reference in its entirety.

BACKGROUND

The present invention relates to laser accessory devices for firearms or other weapons and modular safety cover systems for such laser accessory devices.

SUMMARY

In embodiments, a laser accessory device comprises a housing having a front side having a port, a rear side opposite the front side, a left side, a right side opposite the left side, a top side, and a bottom side opposite the top side. One or more laser emitters are disposed within the housing and are configured to emit a beam through the port. A first cover assembly is positioned on the front side and includes a first safety cover and a first frame securing the first safety cover to the housing. The first safety cover is movable between a closed position covering the port and an open position not covering the port.

In a more limited aspect, the first safety cover juts out beyond the front side to form a visor above the port when the first safety cover is in the open position.

In another more limited aspect, the first safety cover is stowed on the housing when the first safety cover is in the open position.

In yet another more limited aspect, the first safety cover is stowed on the top side of the housing when the first safety cover is in the open position.

In still another more limited aspect, the first cover assembly is removable from the housing, and the laser accessory device further comprises a second cover assembly for positioning on the front side in place of the first cover assembly. The second cover assembly includes a second safety cover and a second frame for securing the second safety cover to the housing, the second safety cover being movable between a closed position covering the port and an open position not covering the port.

In yet another more limited aspect, the first safety cover juts out beyond the front side to form a visor above the port when the first cover assembly is attached to the housing and the first safety cover is in the open position, and the second safety cover is stowed on the top side of the housing when the second cover assembly is attached to the housing and the second safety cover is in the open position.

In yet another more limited aspect, the one or more laser emitters comprises one or more laser diodes.

In yet another more limited aspect, the laser accessory device further comprises a power supply received within the housing and operably connected to the laser diode for energizing the one or more laser emitters.

In yet another more limited aspect, the power supply comprises a battery disposed within a battery compartment in the housing.

In yet another more limited aspect, the laser accessory device further comprises a battery compartment cover configured to releasably cover the battery compartment.

In yet another more limited aspect, the bottom side comprises a clamp for coupling the laser accessory device to a weapon accessory rail.

In yet another more limited aspect, the laser accessory device further comprises one or more activation switches on the top side which are configured to operate the one or more laser emitters.

In yet another more limited aspect, the one or more laser emitters comprises one or more aiming lasers, one or more illumination lasers, or a combination thereof.

In yet another more limited aspect, the one or more laser emitters includes multiple laser emitters.

In yet another more limited aspect, each of the one or more laser emitters emits at one or more wavelengths within a spectrum selected from the group consisting of ultraviolet, visible, and infrared spectra.

In yet another more limited aspect, the one or more laser emitters comprise one or more of a visible light laser for aiming, a visible light laser for illumination, an infrared light laser for aiming, and an infrared light laser for illumination.

In yet another more limited aspect, the first cover assembly is configured to block laser beam emissions from the one or more laser emitters when the first safety cover is in the closed position.

In yet another more limited aspect, the first cover assembly is configured to attenuate laser beam emission intensity from the one or more laser emitters when the first safety cover is in the closed position.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
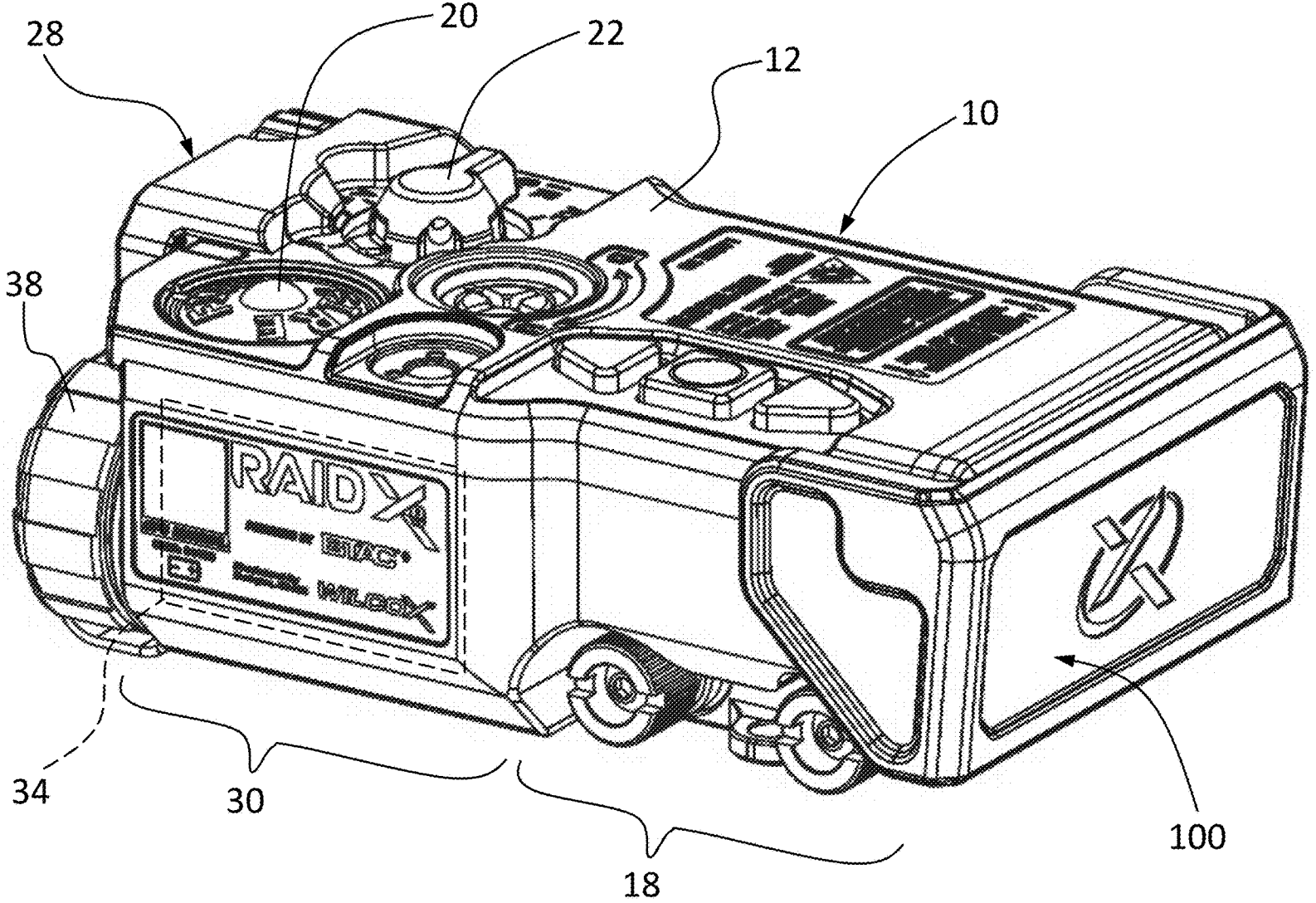
FIG. 1 is an isometric view of an exemplary laser accessory device having a first interchangeable lens cover assembly in the closed or deployed position.
Figure 2:
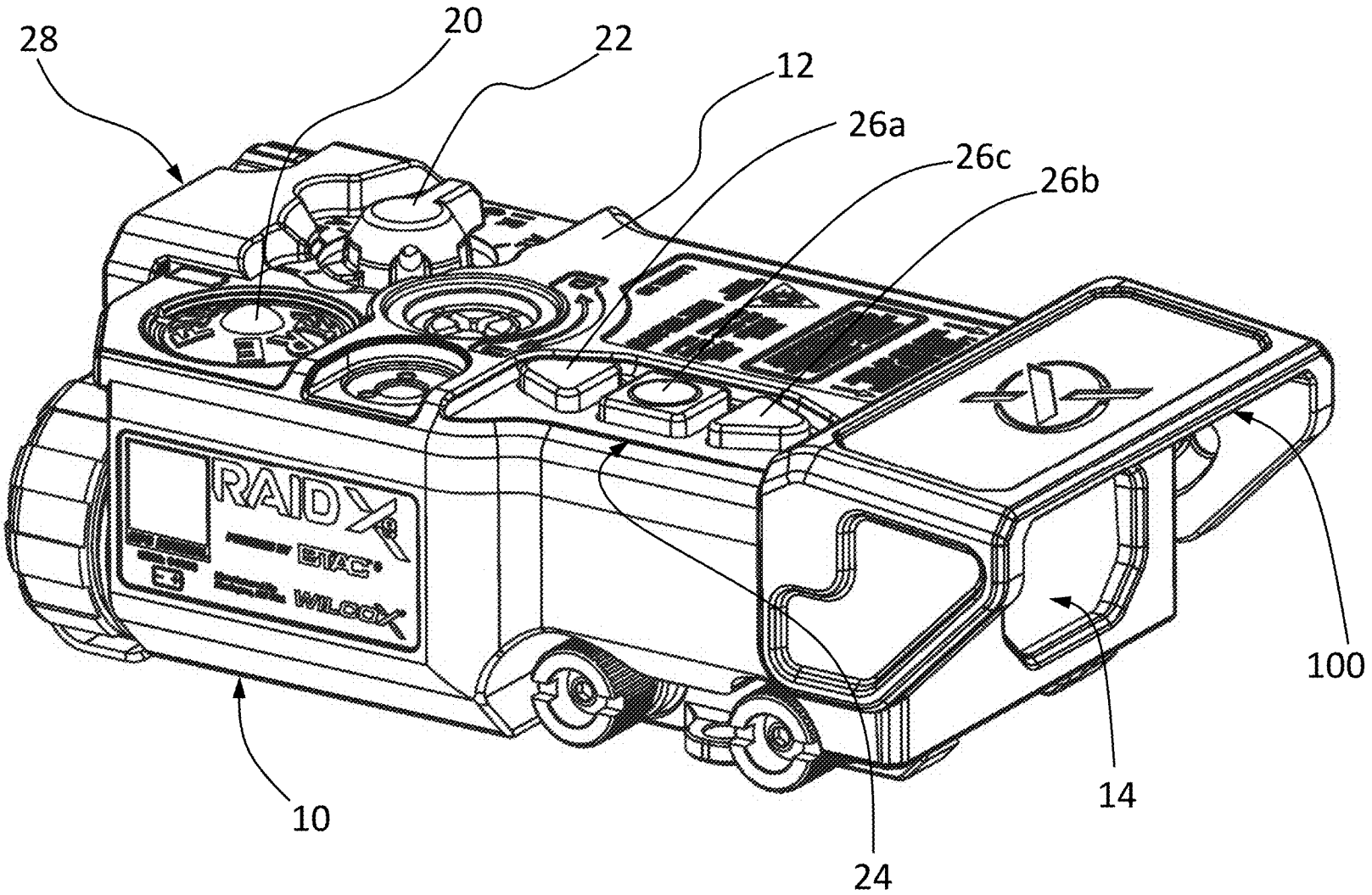
FIG. 2 is an isometric view of the laser accessory device appearing in FIG. 1, wherein the first interchangeable lens cover assembly is in the stowed position.

Firearms and other weapon systems commonly utilize laser emitters for a number of purposes. For example, aiming lasers having one or more laser emitters bore-sighted to the barrel of a firearm or other weapon are used as weapon sights for aiming the weapon. Similarly, laser illuminators emit a beam to illuminate a target area and are often paired with aiming lasers. Laser emitters are also used to mark or designate enemy targets to pinpoint the location of enemy targets and reduce the chance that friendly forces are mistaken as an enemy target. Commonly, laser accessory devices will employ a lens cap or cover to cover the laser emitters when the unit is not in use, e.g., to keep the laser lenses clean and/or dry as well as preventing accidental laser emissions. The present development contemplates a new and improved cover system for laser accessory devices.

Referring now to the drawings, FIGS. 1-5, 6A, 6B, 7A, and 7B illustrate an exemplary laser accessory device comprising a laser accessory device 10 employing a first interchangeable cover assembly 100 and a second interchangeable cover assembly 200. The laser accessory device 10 includes a main housing 12. The main housing 12 includes a lens port 14 on a forward facing end thereof. The housing 12 encloses one or more laser emitters 16*a*, 16*b*, 16*c*, and 16*d*, which can be actuated to emit a laser beam toward a target via the laser lens port 14. The laser emitters 16*a*-16*d* may include various combinations of aiming lasers and laser illuminators, which may emit in wavelengths within a spectrum selected from visible, infrared (IR), near infrared, short wave infrared (SWIR), ultraviolet (UV), and others. A rail clamp or grabber assembly 18 is provided on the housing 12 for attaching the unit 10 to a weapon accessory interface. In certain embodiments, the weapon is a firearm such as a military or tactical rifle, such as a Picatinny rail interface (e.g., as specified in MIL-STD-1913, STANAG 2324), or the like. A fire button 20 is provided to actuate the selected laser emitter(s).

As used herein, terms denoting direction or orientation, such as left, right, front, rear, upper, lower, horizontal, vertical, etc., refer to the orientation of the units 10, 100, and 200 as they appear in the drawings, wherein the laser lens port 14 is considered to be disposed on the front of the unit 10, the controls as described below are considered to be disposed on the top of the unit 10, and the rail grabber assembly 18 is considered to be disposed on the bottom of the unit 10.

The terms "a" or "an," as used herein, are defined as one or more than one. The term "another," as used herein, is defined as at least a second or more. The terms "including" and/or "having" as used herein, are defined as comprising (i.e., open transition). The term "coupled" or "operatively coupled," as used herein, is defined as indirectly or directly connected. All numbers herein are assumed to be modified by the term "about," unless stated otherwise. The recitation of numerical ranges by endpoints includes all numbers subsumed within that range (e.g., 1 to 5 includes 1, 1.5, 2, 2.75, 3, 3.80, 4, and 5).

In certain embodiments, the operational mode of the unit 10 is selected via a mode selection knob 22 and a keypad 24 comprising one or more buttons or keys 26*a*, 26*b*, and 26*c*, are provided to control various functions and parameters of the unit 10, including laser power intensity level and others. In certain embodiments, a display 28 is disposed on a rearward facing end of the housing 12 to provide output to the user in human-viewable form. A battery compartment 30 houses one or more batteries 34 for providing electrical power for the unit 10. A battery compartment cover 38 provides access to the battery compartment 30. In certain embodiments, the laser accessory device may be a RAID-X™ aiming/illumination device available from Wilcox Industries Corp. of Newington, New Hampshire. However, it will be recognized that the modular cover system herein may be adapted for other laser accessory devices.

With respect to FIGS. 1, 2, 6A, and 6B, the first interchangeable cover assembly 100 includes a frame 104 having a central aperture 108 aligned with the lens port 14 on the unit 10. A pair of arms 112 extends from the rearward facing surface of the frame 104 on opposite transverse sides of the frame. Each of the arms 112 has a through hole 116 receiving a respective pivot pin 120. The exterior or outward facing surface of each arm 112 includes a protrusion or boss 124 which is concentric with the respective opening 116.

Each of the arms 112 further includes a downward extending portion 128 having a generally vertical, internally threaded opening 132. The arms 112 and downward extending portion 128 are received in complementary recess features 50 and 52, respectively, on the front surface of the housing 12 to provide a secure, keyed retention of the frame 104 on the housing 12. The frame 104 includes sealing members 184 along the top and bottom edges to provide a sealing interference between the frame 104 and the housing 12 to keep moisture and other environmental contamination away from the laser port 14.

The first interchangeable cover assembly 100 further includes a safety cover in the form of a visor 136 pivotally attached to the frame 104. The visor 136 includes a front plate 140 and a pair of ears 144 extending in the rearward direction on opposite transverse sides of the front plate 140. Each of the ears 144 has a transversely extending blind hole or bore 148 on the inward side thereof. Each bore 148, in turn, further includes a counterbore 152 disposed on an inward surface of the respective ear 144. Each counterbore 152 has a diameter and depth to receive the respective boss 124. Each of the ears 144 further include a curved channel or groove 156. Each curved channel 156, in turn, has a first blind hole or bore 160 at a first end thereof and a second blind hole or bore 164 at a second end thereof.

In certain embodiments, the safety cover 136 is formed of a material that blocks laser emissions. In alternative embodiments, the safety cover 136 may be formed of a material that reduces the intensity of the laser emissions to a level that is generally considered eye-safe.

To assemble the visor 136 to the visor frame 104, the frame is positioned between the ears 144 and the boss 124 is received within the counterbore 152. In certain embodiments, the visor 136 and/or the visor frame 104 are formed of a flexible or resilient material for ease of assembly. In certain embodiments, the visor 136 and visor frame 104 are formed of a polymer material or a polymer/fiber composite material. Each pivot pin 120 is passed through the respective opening 116 and into the blind bore 148.

To assemble the visor assembly 100 to the housing 12, pivot stop screws 168 are removably threaded into complementary threaded openings 32 on opposite sides of the housing 12. Each of the pivot stop screws 168 includes a head portion 172 which protrudes from the adjacent side surface 36 of the housing 12. In certain embodiments, each opening 32 includes a counter bore 40 having a diameter and depth to receive a portion of the head portion 172.

The visor assembly 100 is then placed over the front end of the housing 12 until each head portion 172 is received in the respective curved channel 156. In certain embodiments, the visor assembly 100 components are formed of flexible or resilient materials to allow the visor assembly 100 to flex or deform slightly to aid in positioning the head portions 172 in the grooves 156. First and second threaded fasteners 54 are then passed through respective openings 44 in the housing 12 and removably engage a respective one of the threaded openings 132 on the visor frame 104.

In operation, when the visor 136 is in the closed position (see FIG. 1), each head portion 172 of the pivot stop screws 168 is received within a respective one of the first bores 160. When it is desired to open the cover assembly 100, the visor 136 is pivoted upward in relation to the frame 104 about the pivot pins 120 which define a pivot axis 180. As the visor 136 is pivoted, the head portions 172 run in the respective curved channels 156 until the head portions engage the respective bores 164. The bores 160 and 164 cooperate with the head portions 172 to provide a positive stop or detent when the visor 136 is in the deployed and stowed positions, respectively.

When the visor 136 is in the open position (see FIG. 2), the visor plate portion 140 and ears 144 extend beyond a front surface 48 of the housing 12. In this manner, the visor 136 acts as a rain/precipitation shield to protect the laser port from rain, snow, etc., when the unit 10 is used in the rain or other precipitation conditions. The protruding visor 136 also advantageously acts as a shield against off-angle viewing of the aiming and illumination beam emitters, thereby making it more difficult to pinpoint the location of the user.

When it is desired to remove the visor assembly 100, the threaded fasteners 54 are removed that the visor assembly is manually removed by disengaging the head portions 172 from the grooves 156. The pivot stop screws 168 may also be removed from the housing 12 when the visor assembly 100 is not in use.

With reference now to FIGS. 3, 4, 7A, and 7B, the laser accessory device 10 appears with the second interchangeable cover assembly 200 used in place of the first interchangeable cover assembly 100. The cover assembly 200 includes a frame 204 having a central aperture 208 aligned with the lens port 14 on the unit 10. A pair of arms 212 extends from the rearward facing surface of the frame 204. Each of the arms 212 has a through hole or bore 216. Each bore 216 includes a countersink 218 on the inward facing side thereof. On the outward facing side of each arm 212, there is a protruding boss 224 which is concentric with the bore 216. Each boss 224 includes a keyed or noncircular (e.g., generally rectangular in the illustrated embodiment) counterbore 222 which is concentric with the bore 216. The counterbore 222 receives a respective complementary noncircular post portion 226 of a pivot cap 220. The pivot cap 220 further includes an enlarged diameter head 230.

Each of the arms 212 further includes a first protrusion 214 which is complementary with the recess feature 50 on the housing 12 for providing a secure, keyed retention of the frame 204 on the housing 12. Each of the arms 212 also includes a second protrusion 228 having a generally vertical, internally threaded opening 232. The second protrusion 228 is received in the complementary recess feature 52 on the front surface of the housing 12 to additionally provide a secure, keyed retention of the frame 204 on the housing 12. The frame 204 includes sealing members 284 along the top and bottom edges to provide a sealing interference between the frame 204 and the housing 12 to keep moisture and other environmental contamination away from the laser port 14.

The second interchangeable cover assembly 200 further includes a safety cover 236 pivotally attached to the frame 204. The cover 236 includes a front cover panel 240 and a pair of ears 244 extending in the rearward direction on opposite transverse sides of the front panel 240. The front panel 240 is complementary with and covers the laser port 14 when in the closed position. Each of the ears 244 has an aperture 248 configured to receive the boss 224 therein. In certain embodiments, the safety cover 236 is formed of a material that blocks laser emissions. In alternative embodiments, the safety cover 236 may be formed of a material that reduces the intensity of the laser emissions to a level that is generally considered eye-safe.

To assemble the safety cover 236 to the frame 204, the frame 204 is positioned between the ears 244 and each boss 224 is received within a respective opening 248. In certain embodiments, the frame 204 is formed of a flexible or resilient material such as a molded plastic material and the safety cover 236 is formed of a rubber or other elastomeric material, such as a natural or synthetic rubber material. The post 226 of each pivot cap 220 is received in the respective noncircular counterbore 222. Threaded fasteners 210 pass through the holes 216 and threadably engage internal threads within a central opening 234 in the respective posts 226. In certain embodiments, the fasteners 210 are flathead screws having a head portion 238 which is received in the countersink 218 so that each of the head portions 238 is flush with the inward facing surface of the respective arm 212.

To assemble the cover assembly 200 to the housing 12, the cover assembly 200 is placed over the front end of the housing 12 until the protrusions 214 and 228 engage the respective complementary recesses 50 and 52 on the housing 112. First and second threaded fasteners 54 are then passed through respective openings 44 in the housing 12 and removably engage a respective one of the threaded openings 232 on the frame 204.

Figure 3:
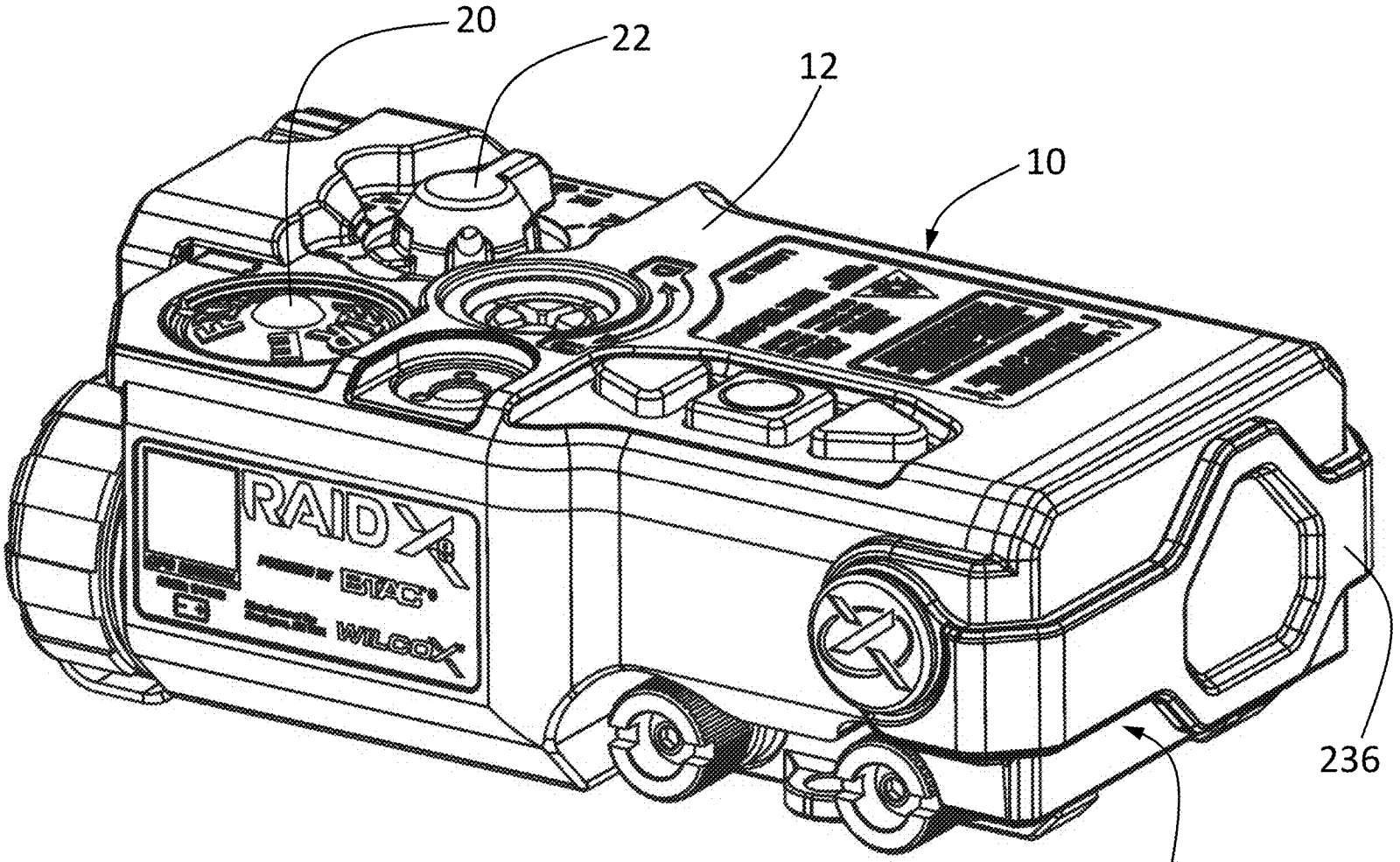
FIG. 3 is an isometric view of the laser accessory device appearing in FIGS. 1 and 2, wherein a second interchangeable lens cover assembly, shown in the deployed position, is used in place of the first interchangeable lens cover assembly.
Figure 4:
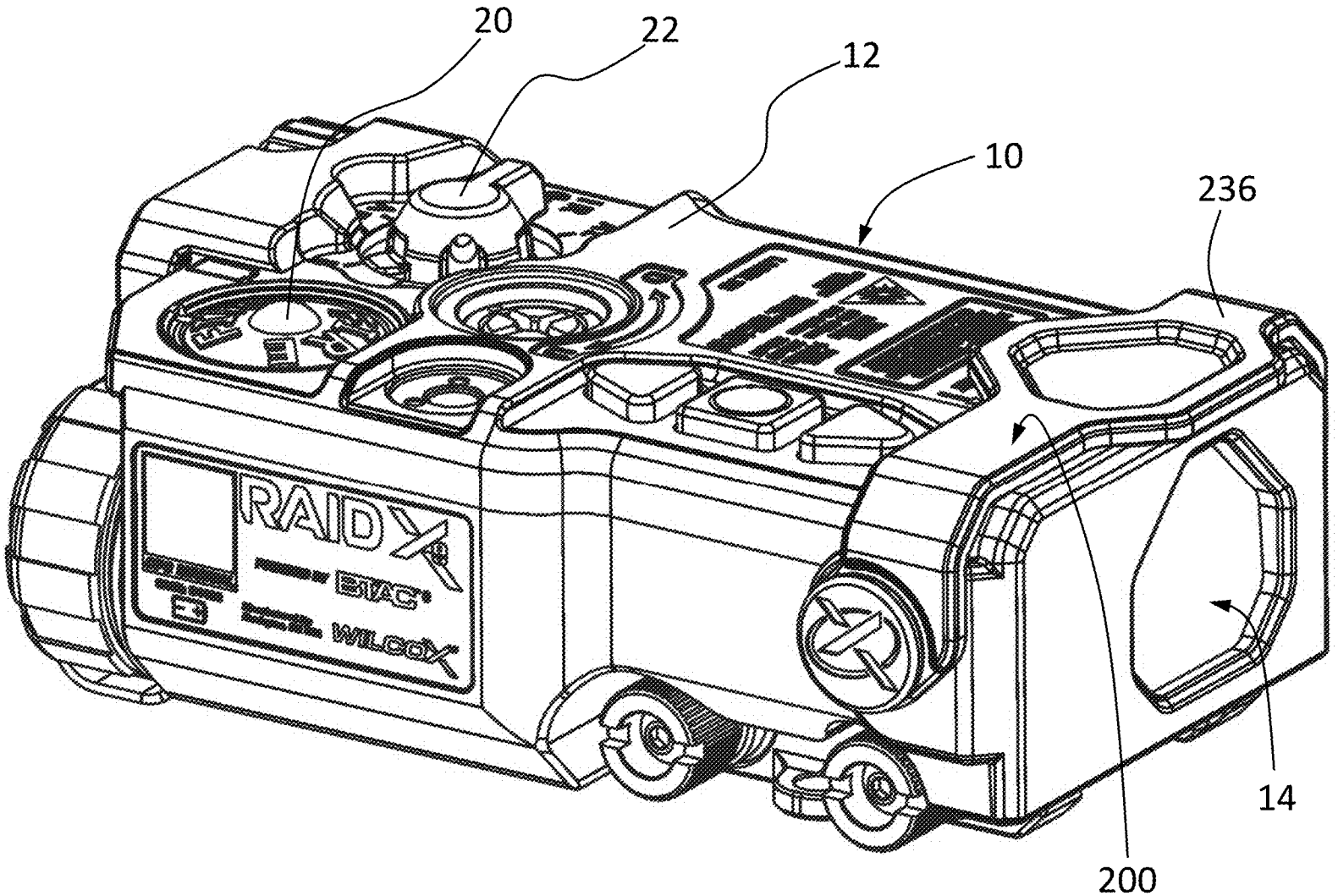
FIG. 4 is an isometric view of the laser accessory device configuration appearing in FIG. 3, wherein the second interchangeable lens cover assembly is shown in the stowed position.
Figure 5:
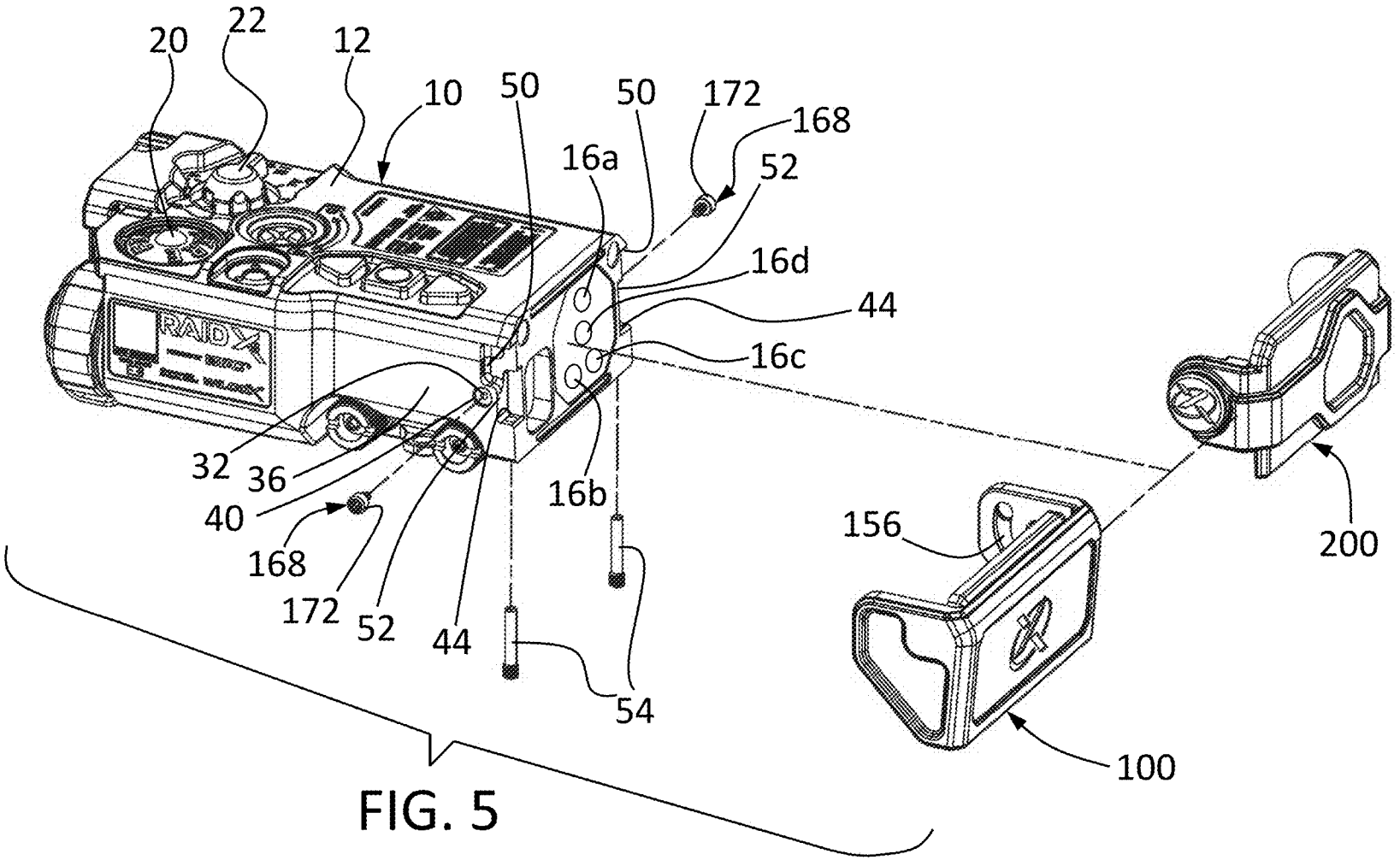
FIG. 5 is a partially exploded view illustrating the modular nature of the first and second interchangeable lens cover assemblies.
Figure 6B:
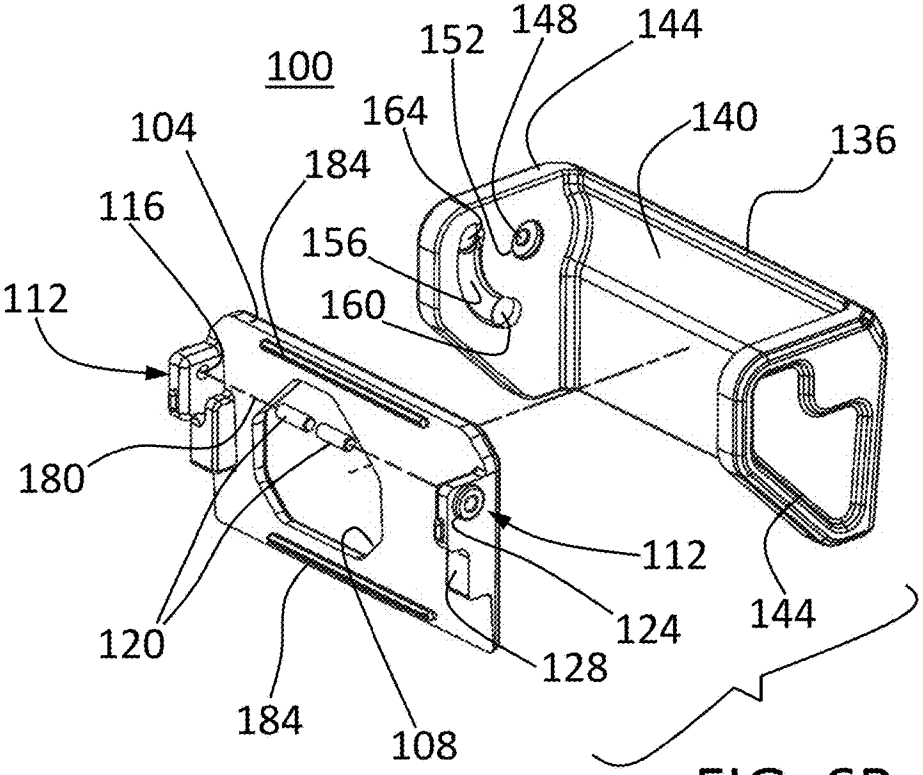
FIG. 6B is an exploded, isometric view of the first interchangeable lens cover assembly taken from the rear and side.
Figure 6A:
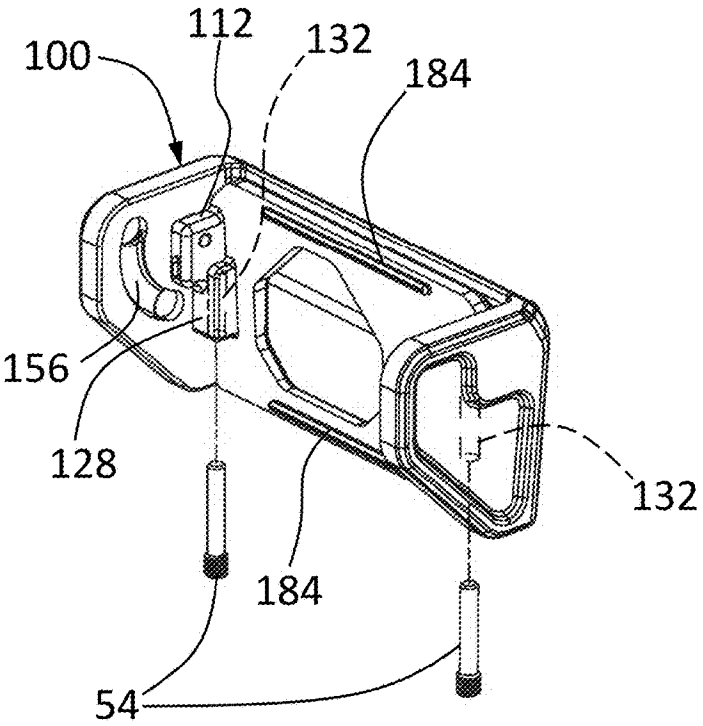
FIG. 6A is an isometric view of the first interchangeable lens cover assembly taken from the rear and side.
Figure 7B:
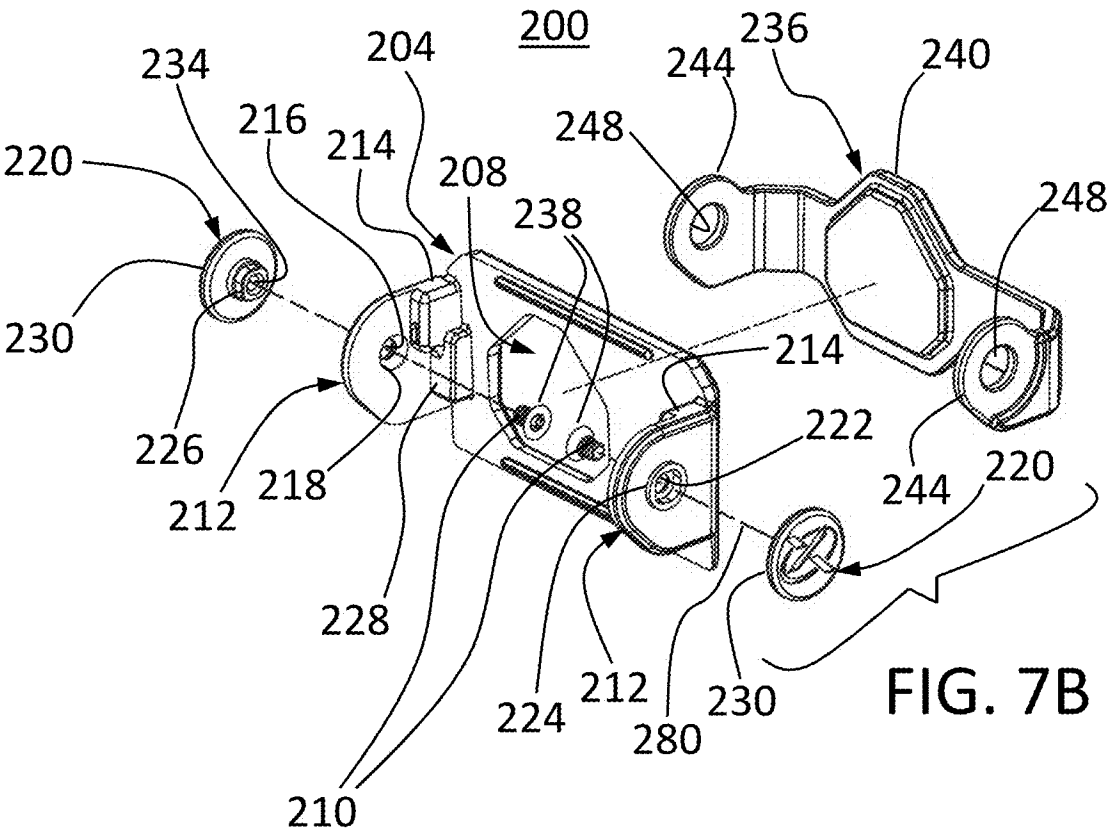
FIG. 7B is an exploded, isometric view of the second interchangeable lens cover assembly taken from the rear and side.
Figure 7A:
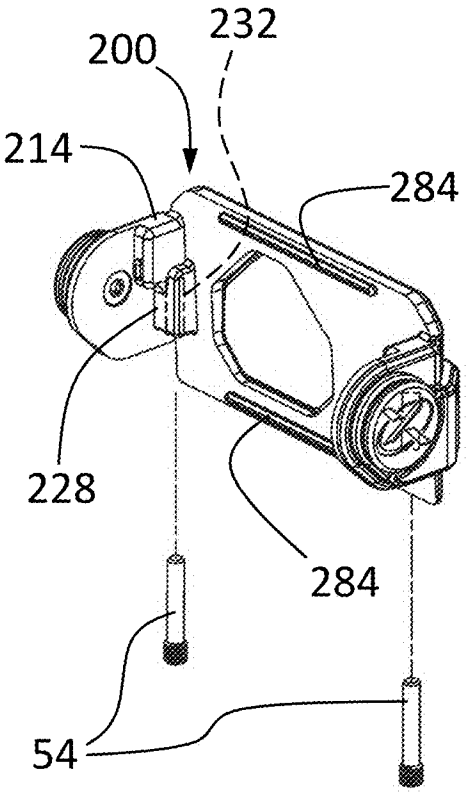
FIG. 7A is an isometric view of the second interchangeable lens cover assembly taken from the rear and side.

FIG. 3 illustrates the safety cover 236 in the closed or deployed position. When it is desired to open the cover assembly 200 to the open or stowed position as shown in FIG. 4, the safety cover 236 is pivoted upward in relation to the frame 204 about the pivot caps 220, which define a pivot axis 280. As the cover 204 is pivoted, rotation of the pivot cap 220 is resisted because of the keyed or noncircular configuration of the post 226 and the counterbore 222, thereby reducing the chance of inadvertently unscrewing the fasteners 210 from the pivot cap 220.

When it is desired to remove the safety cover assembly 200 from the unit 10, the threaded fasteners 54 are removed and the safety cover assembly 200 is manually removed by disengaging the protrusions 214, 228 from the respective recesses 50, 52.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A laser accessory device, comprising:

a housing having a front side having a port, a rear side opposite the front side, a left side, a right side opposite the left side, a top side, and a bottom side opposite the top side;

one or more laser emitters within the housing configured to emit a beam through the port;

a first cover assembly positioned on the front side, the first cover assembly including a first safety cover and a first frame securing the first safety cover to the housing, the first safety cover movable between a closed position covering the port and an open position not covering the port;

the first frame having opposing left and right arms extending on the left and right sides, respectively, each of the left and right arms having an opening receiving a pivot pin along a pivot axis between the first safety cover and the first frame;

the first safety cover including left and right ears engaging the left and right arms, respectively, each of the left and right ears having respective left and right curved channels;

left and right pivot stop members disposed on the left and right sides, respectively, the left and right pivot stop members configured to slidably engage the left and right curved channels, respectively;

the left and right stop members configured to run within the left and right curved channels, respectively, during pivoting movement of the first safety cover in relation to the first frame.

2. The laser accessory device of claim 1, wherein the first safety cover juts out beyond the front side to form a visor above the port when the first safety cover is in the open position.

3. The laser accessory device of claim 1, wherein the first safety cover is stowed on the housing when the first safety cover is in the open position.

4. The laser accessory device of claim 1, wherein the first safety cover is stowed on the top side of the housing when the first safety cover is in the open position.

5. The laser accessory device of claim 1, wherein the first cover assembly is removable from the housing, the laser accessory device further comprising:

a second cover assembly for positioning on the front side in place of the first cover assembly, the second cover assembly including a second safety cover and a second frame for securing the second safety cover to the housing, the second safety cover movable between a closed position covering the port and an open position not covering the port.

6. The laser accessory device of claim 1, wherein the first safety cover juts out beyond the front side to form a visor above the port when the first cover assembly is attached to the housing and the first safety cover is in the open position, and further wherein the second safety cover is stowed on the top side of the housing when the second safety cover assembly is attached to the housing and the second safety cover is in the open position.

7. The laser accessory device of claim 1, wherein the one or more laser emitters comprises one or more laser diodes.

8. The laser accessory device of claim 1, further comprising a power supply received within the housing and operably connected to the laser diode for energizing the one or more laser emitters.

9. The laser accessory device of claim 8, wherein the power supply comprises a battery disposed within a battery compartment in the housing.

10. The laser accessory device of claim 9, further comprising a battery compartment cover configured to releasably cover the battery compartment.

11. The laser accessory device of claim 1, the bottom side comprising a clamp for coupling the laser accessory device to a weapon accessory rail.

12. The laser accessory device of claim 1, further comprising one or more activation switches on the top side and configured to operate the one or more laser emitters.

13. The laser accessory device of claim 1, wherein the one or more laser emitters comprises one or more aiming lasers, one or more illumination lasers, or a combination thereof.

14. The laser accessory device of claim 1, wherein the one or more laser emitters includes multiple laser emitters.

15. The laser accessory device of claim 1, wherein each of the one or more laser emitters emits at one or more wavelengths within a spectrum selected from the group consisting of ultraviolet, visible, and infrared spectra.

16. The laser accessory device of claim 1, wherein the one or more laser emitters comprise one or more of:

a visible light laser for aiming;

a visible light laser for illumination;

an infrared light laser for aiming; and an infrared light laser for illumination.

17. The laser accessory device of claim 1, wherein the first cover assembly is configured to block laser beam emissions from the one or more laser emitters when the first safety cover is in the closed position.

18. The laser accessory device of claim 1, wherein the first cover assembly is configured to attenuate laser beam emissions from the one or more laser emitters when the first safety cover is in the closed position.

19. The laser accessory device of claim 1, further comprising:

each of the left and right curved channels including a first bore and a second bore formed therein;

the first bore of the left curved channel cooperating with the left stop member and the first bore of the right curved channel cooperating with the right stop member to provide a positive stop when the first safety cover is in the closed position; and the second bore of the left curved channel cooperating with the left stop member and the second bore of the right curved channel cooperating with the right stop member to provide a positive stop when the first safety cover is in the open position.

20. The laser accessory device of claim 1, wherein the left and right pivot stop members are threaded members configured to detachably engage the housing.

* * * * *